US011582559B2

(12) United States Patent
Grinnip, III

(10) Patent No.: US 11,582,559 B2
(45) Date of Patent: Feb. 14, 2023

(54) SEGMENTED STATOR PLATES FOR ELECTROSTATIC TRANSDUCERS

(71) Applicant: Shure Acquisition Holdings, Inc., Niles, IL (US)

(72) Inventor: Roger Stephen Grinnip, III, Lake Zurich, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 17/303,379

(22) Filed: May 27, 2021

(65) Prior Publication Data

US 2021/0377671 A1 Dec. 2, 2021

Related U.S. Application Data

(60) Provisional application No. 63/032,364, filed on May 29, 2020.

(51) Int. Cl.
*H04R 19/02* (2006.01)
*H04R 7/14* (2006.01)

(52) U.S. Cl.
CPC ..... *H04R 19/02* (2013.01); *H04R 7/14* (2013.01)

(58) Field of Classification Search
CPC ..... H04R 19/02; H04R 7/14
See application file for complete search history.

(56) References Cited

U.S. PATENT DOCUMENTS

| | | | | |
|---|---|---|---|---|
| 6,188,772 | B1 | 2/2001 | Norris | |
| 6,459,799 | B1 | 10/2002 | Smits | |
| 6,785,393 | B2 | 8/2004 | Lipponen | |
| 7,158,646 | B2 | 1/2007 | Bank | |
| 7,925,033 | B2 | 4/2011 | Okazawa | |
| 8,000,483 | B2 | 8/2011 | De Haan | |
| 9,723,423 | B2 | 8/2017 | Uchida | |
| 9,725,047 | B2 | 8/2017 | Orellana | |
| 10,189,699 | B2 | 1/2019 | Walther | |
| 2010/0325873 | A1 | 12/2010 | Van Dongen | |
| 2012/0033834 | A1 * | 2/2012 | Mellow | H03F 3/2173 381/396 |
| 2019/0045306 | A1 | 2/2019 | Palmer | |

FOREIGN PATENT DOCUMENTS

| | | | |
|---|---|---|---|
| GB | 537931 | 7/1941 | |
| GB | 537931 A * | 7/1941 | |
| GB | 1228775 | 4/1971 | |
| WO | WO0035246 A1 * | 6/2000 | H04R 7/14 |

(Continued)

OTHER PUBLICATIONS

Acorn ESL Kit, Information Sheet, ER Audio, Downloaded from <http://www.eraudio.com.au/DIY_SpeakerKits/Acorn_ESL_kit/acom_esl_kit.html> on Feb. 18, 2019.

(Continued)

*Primary Examiner* — Sunita Joshi
(74) *Attorney, Agent, or Firm* — Neal, Gerber & Eisenberg LLP

(57) ABSTRACT

A segmented stator plate for an electrostatic transducer is provided. The segmented stator plate may have multiple electrically separate sections that can be independently operated and are usable to generate sound and/or detect sound waves in the electrostatic transducer.

18 Claims, 11 Drawing Sheets

(56) References Cited

FOREIGN PATENT DOCUMENTS

| | | | | |
|---|---|---|---|---|
| WO | WO-0035246 A1 * | 6/2000 | ..... | H04R 19/02 |
| WO | 2007115358 | 10/2007 | | |
| WO | 2014039180 | 3/2014 | | |

OTHER PUBLICATIONS

Chiang, et al., "Vibration and sound radiation of an electrostatic speaker based on circular diaphragm," The Journal of the Acoustical Society of America, vol. 137, Issue 4, Apr. 2015, pp. 1714-1721, 9 pp.

International Search Report and Written Opinion for PCT/US2021/070623 dated Aug. 23, 2021, 10 pp.

List, "Electrostatic Loudspeakers: High End HiFi You Can Build Yourself," Hackaday, Aug. 3, 2016, 27 pp.

Yuin, "MartinLogan Launches the Renaissance ESL 15A," New York Audio Show, Oct. 20, 2016, 3 pp.

* cited by examiner $$v_{104} = \frac{v_{350}}{1 + sR_{360}C_{104}}$$

$$v_{102} = v_{350}$$

SEGMENTED STATOR PLATES FOR ELECTROSTATIC TRANSDUCERS

CROSS-REFERENCE

This application claims priority to U.S. Provisional Patent Application No. 63/032,364, filed on May 29, 2020, the contents of which are incorporated herein by reference in their entirety.

TECHNICAL FIELD

This application generally relates to segmented stator plates used in electrostatic transducers. In particular, this application relates to stator plates having multiple electrically separate sections that that can be independently operated and are usable to generate sound and/or detect sound waves in electrostatic transducers.

BACKGROUND

Loudspeakers, headphones, and earphones can utilize an electrostatic transducer for sound reproduction that includes a tensioned conductive low-mass diaphragm positioned between a pair of conductive stator plates. Small air gaps may be present between the diaphragm and the stator plates, and the diaphragm may have a stationary charge relative to the stator plates. If no signal is applied to the stator plates, the diaphragm may be static and stays centered between the stator plates. When an audio signal is applied across the stator plates, an electric field is generated between the plates. Because the diaphragm has a fixed charge, a net force imbalance may be created over the diaphragm, which displaces the diaphragm. In turn, the air adjacent to the diaphragm may be displaced to create sound corresponding to the audio signal.

As a result, loudspeakers, headphones, and earphones using electrostatic transducers may have very low harmonic distortion, full bandwidth frequency response, and high fidelity sound reproduction, as compared to loudspeakers, headphones, and earphones with moving coil transducers. Electrostatic transducers may have these characteristics due to the push-pull, constant charge electrostatic drive and the relatively low mass of the diaphragm. In particular, the low harmonic distortion may be due to the push-pull electrostatic drive and the nearly constant bias charge on the diaphragm.

Condenser microphones for sound detection may use a tensioned conductive low-mass diaphragm separated by an air gap with a conductive stator plate, or suspended between two stator plates with an air gap on each side. A voltage may be present on the diaphragm, relative to the stator plates, or a permanent charge (i.e., electret) may be applied to the diaphragm and stator plates for biasing. The diaphragm moves and vibrates when sound waves strike it, which changes the distance between the diaphragm and the stator plate(s). When this occurs, the capacitance between the diaphragm and the stator plate(s) changes, which can be converted into an output audio signal.

Arrays that generate sound (e.g., speaker arrays) and arrays that sense sound (e.g., microphone arrays) are indistinguishable from the creation of multipole acoustic devices that enable the processing of amplitude and phase relationships between individual poles in order to create directional attributes. Arrays typically require geometric separation between sections used for sound generation and sections used for sound sensing in order to achieve spatialization for beamforming and sound field synthesis. Such an array has discrete transducers that are distributed over fixed locations, and each transducer is relatively small as compared to the overall size of the array. However, small transducers (regardless of their type, e.g., moving coil, piezoelectric, electrostatic, etc.) have inherent limitations attributable to their size, such as diaphragm surface area, diaphragm stiffness, and diaphragm mass. These inherent limitations small transducers can result in performance limitations, such as volume velocity and bandwidth limitations when generating sound in loudspeakers, or noise and frequency response limitations when sensing sound in microphones.

Accordingly, there is an opportunity for a segmented stator plate with independent, electrically separate sections that can be driven and/or sensed separately to enable more complex configurations for electrostatic transducers.

SUMMARY

This invention is intended to solve the above-noted problems by providing a segmented stator plate usable in an electrostatic transducer that is designed to, among other things: (1) have separate independent receiving sections for sensing sound; (2) have separate independent driving sections for generating sound; (3) have combined independent receiving and actuating sections for respectively sensing and generating sound; (4) be used as a loudspeaker array for spatialization and sound field synthesis; and (5) be used as a microphone array.

In an embodiment, an electrostatic transducer includes a diaphragm in electrical contact with a bias voltage, and a pair of stator plates. Each of the pair of stator plates includes a first section in electrical contact with a first audio signal, a second section electrically separate from the first section and in electrical contact with a second audio signal, and a boundary area between the first section and the second section. The diaphragm generates sound when the bias voltage, the first audio signal, and the second audio signal are supplied.

In another embodiment, an electrostatic transducer includes a diaphragm in electrical contact with a voltage, and a stator plate. The stator plate includes a first section in electrical contract with the voltage, a second section electrically separate from the first section and in electrical contact with the voltage, and a boundary area between the first section and the second section. An audio signal is generated by the diaphragm and the stator based on sound waves detected by the diaphragm when the voltage is supplied.

In a further embodiment, a stator plate for an electrostatic transducer includes a plurality of sections and a plurality of non-conductive boundary areas. Each of the plurality of sections is electrically separate from each other of the plurality of sections. Each of the plurality of sections is separated from a neighboring section by one of the plurality of boundary areas. At least one of the plurality of boundary areas is configured to be located at a node line of a mode of a diaphragm of the electrostatic transducer.

In another embodiment, a stator plate for an electrostatic transducer includes a plurality of sections and a plurality of non-conductive boundary areas. Each of the plurality of sections is electrically separate from each other of the plurality of sections. Each of the plurality of sections is separated from a neighboring section by one of the plurality of boundary areas. A first subset of the plurality of sections is configured to be driven to generate sound, and a second subset of the plurality of sections is configured to sense sound and generate an audio output signal.

In a further embodiment, a stator plate for an electrostatic transducer includes a first section, a second section electrically separate from the first section, and a boundary area between the first section and the second section. The boundary area is configured to be located at a node line of a mode of a diaphragm.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
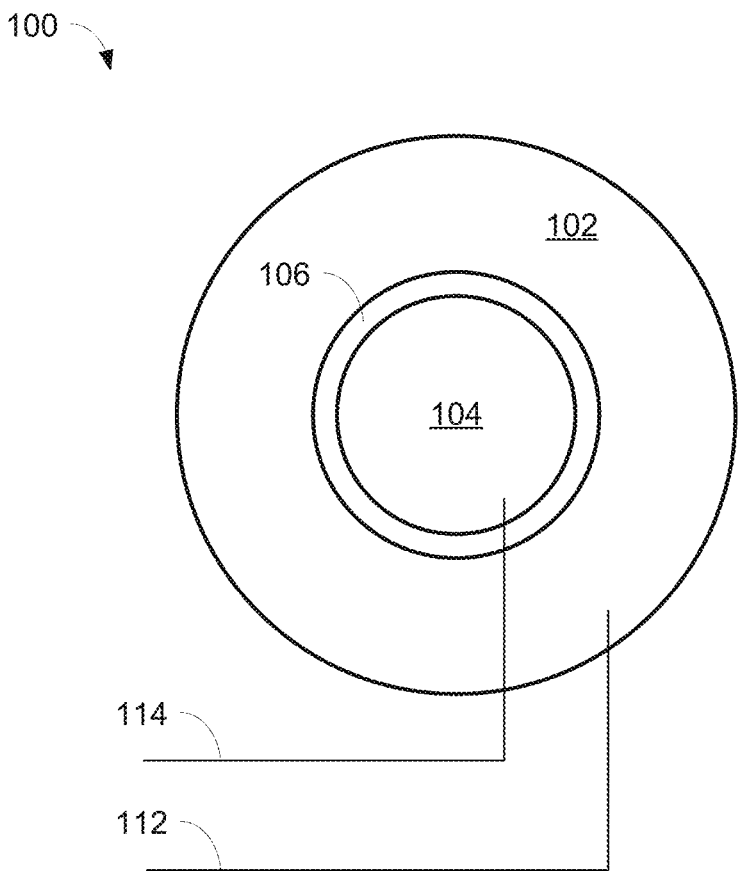
FIG. 1 is an exemplary depiction of a circular segmented stator plate, in accordance with some embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

The segmented stator plate described herein can include multiple sections that may be independently operated, which can enable electrostatic transducers using the segmented stator plate to attain improved performance and optimize their frequency response. A microphone array can be created when the multiple sections of a segmented stator plate are utilized for sensing sound. For example, planar multipole sensors can be created that are noise cancelling in the far field while being highly sensitive in the near field. A loudspeaker array for spatialization and sound field synthesis can be created when the multiple sections of a segmented stator plate are utilized for generating sound. Possible spatial acoustic fields can include enhanced directivity in near field monitoring situations, and synthesized dynamic (i.e., moving) sources. A hybrid array for generating and sensing sound may include specific stator segments for each function. Such a hybrid array could be used for noise cancelling purposes.

Electrostatic transducers are inherently optimized for high frequency sound generation and sensing due to the moving mass (diaphragm) being smaller than the acoustical mass in contact with the diaphragm, in contrast to other transducers (e.g., moving coil). Furthermore, the electrically isolated addressable stator segments of a segmented stator plate can provide localized sound generation and/or sensing that can achieve the geometric separation necessary for spatialization. Because the charged diaphragm is common to all of the stator segments of the segmented stator plate, the individual elements for sound generation and/or sensing are not limited by the stiffness of the diaphragm related to the area of a particular segment, but rather to the stiffness of the diaphragm related to the entire area of the diaphragm.

Assuming small, linear excursions of the diaphragm (when excited or sensing), the diaphragm displacement distribution may be described by a weighted sum of an infinite-dimensional, orthonormal function set (i.e., mode shapes), which directly correlates to the imposed force distribution. The direct correlation of between the diaphragm displacement distribution and the imposed force distribution allows spatial variation to be encoded into the diaphragm displacement distribution.

With respect to sound generation, the force distribution directly correlates to the imposed electric field associated with the stator plate segmentation. The resulting diaphragm displacement distribution can encode multipole sources within the same diaphragm with a spatial resolution approaching the stator plate segmentation resolution, and can be combined to synthesize acoustic fields in the air space that is in contact with the surface of the diaphragm.

With respect to sound sensing, the diaphragm displacement distribution directly correlates to the imposed pressure distribution. Wave propagation information (i.e., amplitude, phase, and direction) that is inherent to the pressure distribution will be encoded into the diaphragm displacement distribution through the pressure distribution. The appropriate stator plate segmentation and processing of the signals from the stator segments may align with specific displacement distributions to decode the wave propagation information. Accordingly, directional sensing can be effectively created within a single diaphragm electrostatic transducer having a segmented stator plate.

In both sound generation and sensing, the stator plate segmentation is strongly coupled to the force distribution through diaphragm modal behavior. As such, optimization should be over the entire system including the diaphragm and stator plate(s). The system can also isolate specific dynamic behaviors (such as removing, accentuating, and/or combining modal contributions) as these behaviors relate to spatial acoustic fields adjacent to the transducer. In this way, the use of segmented stator plates in a system can allow optimal modal control since the system can be "reconfigured" by processing the stator segment signals without needing to mechanically change the physical construction of the system, e.g., when modal behavior is controlled using excitation point(s) and mass distribution. Systems with segmented stator plates may therefore be dynamic and can allow for changes over time. In addition, such systems can support parallel processing of signals to elicit concurrent signal feeds when performing sound sensing.

Figure 2:
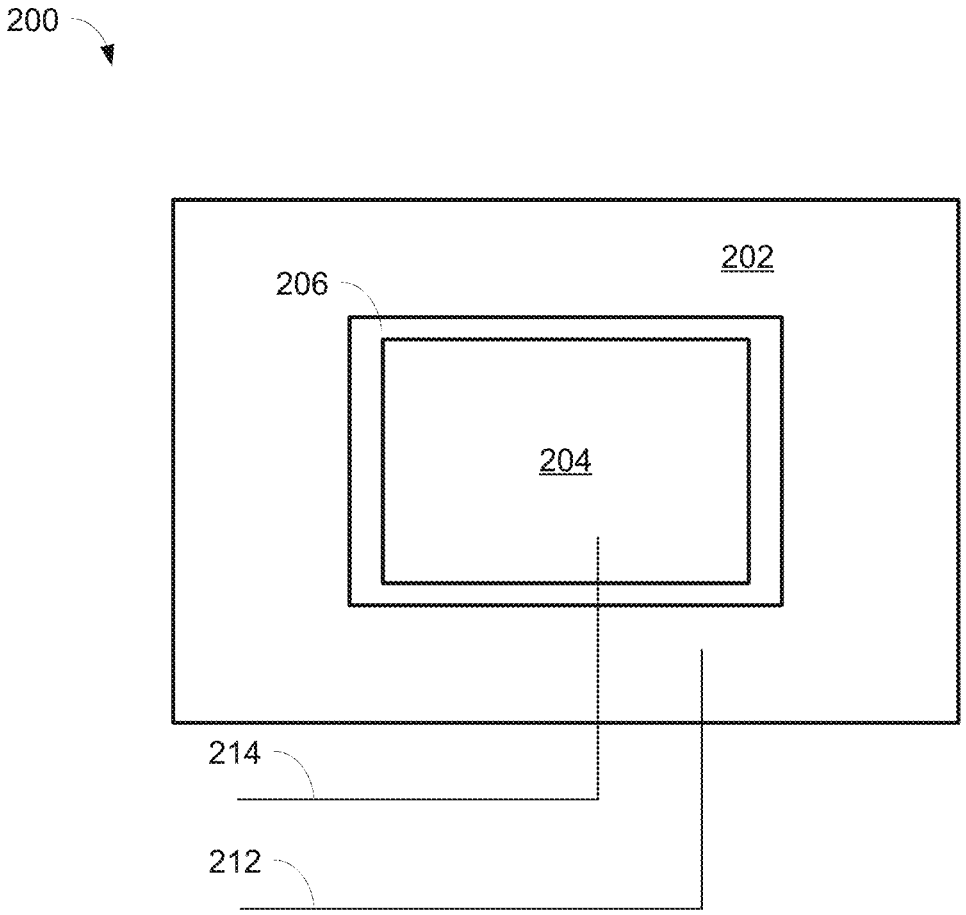
FIG. 2 is an exemplary depiction of a rectangular segmented stator plate, in accordance with some embodiments.

FIG. 1 is an exemplary depiction of a circular segmented stator plate 100 that may be used in an electrostatic transducer, such as a loudspeaker, headphone, earphone, and/or microphone. FIG. 2 is an exemplary depiction of a rectangular segmented stator plate 200 that may also be used in an electrostatic transducer. While FIGS. 1 and 2 show a circular and a rectangular segmented stator plate 100 and 200, respectively, it should be understood that other shapes of the segmented stator plate and configurations of stator sections are contemplated and possible, such as subdivided rectangular stator plates, linearly subdivided stator plates, and circular stator plates with finer annular segments and/or angular segmentation.

Figure 9:
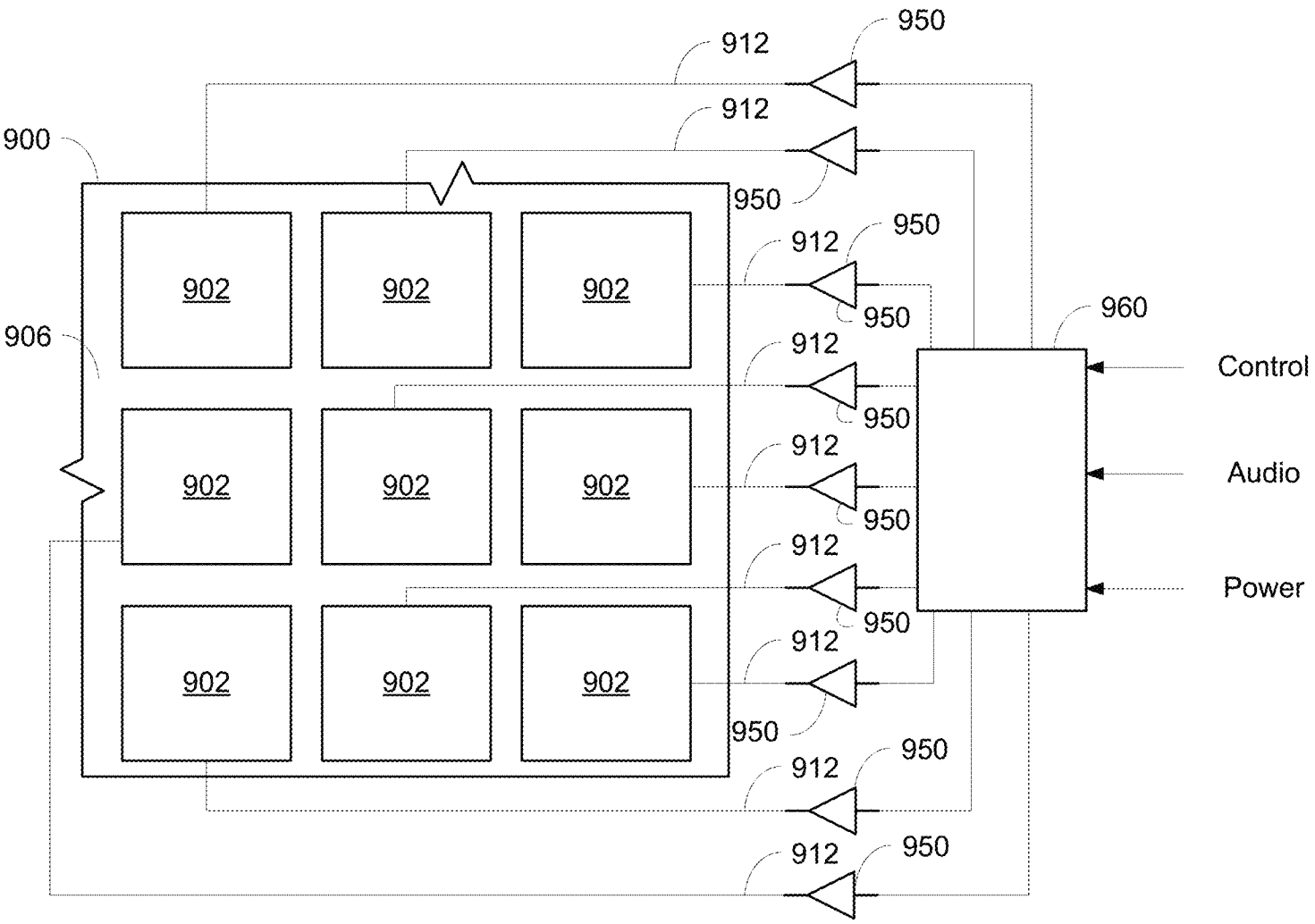
FIG. 9 is a schematic diagram and an exemplary depiction of a portion of an electrostatic transducer having a segmented stator plate and that can generate sound, in accordance with some embodiments.
Figure 10:
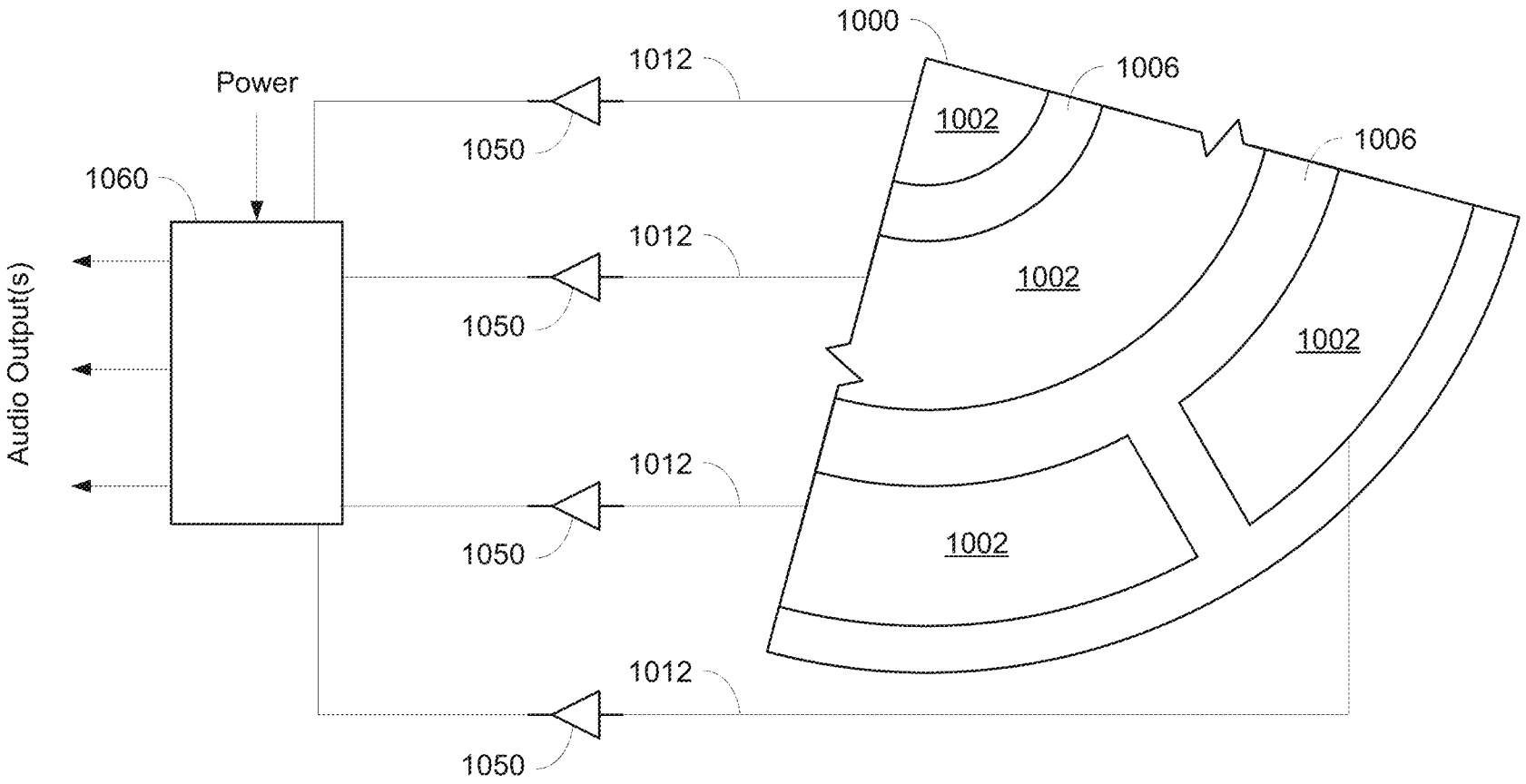
FIG. 10 is a schematic diagram and an exemplary depiction of a portion of an electrostatic transducer having a circular segmented stator plate and that can sense sound, in accordance with some embodiments.
Figure 11:
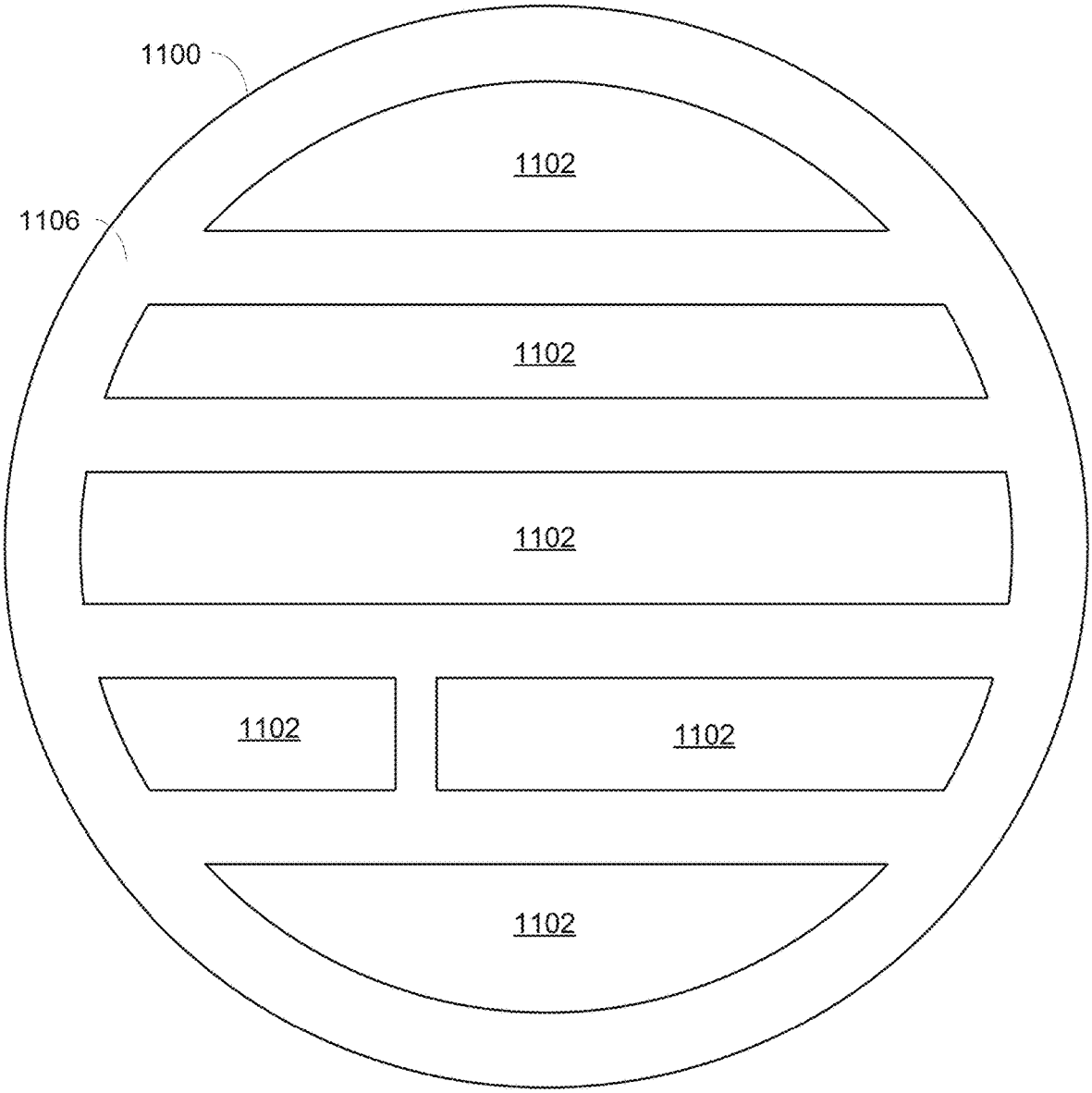
FIG. 11 is an exemplary depiction of a circular segmented stator plate, in accordance with some embodiments.

For example, FIG. 9 is an exemplary depiction of a portion of a rectangular segmented stator plate 900 with multiple stator sections that are subdivided in multiple dimensions. It should be noted that although the segmented stator plate 900 is shown in FIG. 9 in the context of generating sound, e.g., in a loudspeaker, the segmented stator plate 900 may also be used for sensing sound, e.g., in a microphone, in other embodiments. FIG. 10 is an exemplary depiction of a portion of a circular segmented stator plate 1000 with multiple stator sections that are concentrically and angularly segmented. It should be noted that although the segmented stator plate 100 is shown in FIG. 10 in the context of sensing sound, e.g., in a microphone, the segmented stator plate 1000 may also be used for generating sound, e.g., in a loudspeaker, in other embodiments. FIG. 11 is an exemplary depiction of a circular segmented stator plate 1100 with multiple stator sections that are linearly subdivided in multiple dimensions.

Depending on the application, the shape of the stator plate and segmentation of the stator plate may correlate to the shape of the diaphragm and/or node lines of the diaphragm modes, the internal acoustic cavity node lines, and/or the external pressure distribution (which can vary with frequency and source incidence). Moreover, the stator sections may or may not be uniformly distributed, sized, and/or shaped. For example, stator sections may be clustered together and/or asymmetrically arranged, in some embodiments.

The segmented stator plates 100, 200, 900, 1000, and 1100 may include multiple electrically separate sections that can be independently operated. In FIG. 1, the segmented stator plate 100 may include an outer concentric stator section 102 and a central circular stator section 104. In FIG. 2, the segmented stator plate 200 may include an outer concentric stator section 202 and a central rectangular stator section 204. Although two stator sections are shown in FIGS. 1 and 2, any number, shape, and/or configuration of stator sections are contemplated and possible in a segmented stator plate. For example, the segmented stator plate 900 of FIG. 9 may include multiple stator sections 902 arranged in a matrix pattern, the segmented stator plate 1000 of FIG. 10 may include multiple stator sections 1002 arranged concentrically, and the segmented stator plate 1100 of FIG. 11 may include multiple stator sections 1102 arranged linearly in multiple dimensions.

The stator sections 102, 104, 202, 204, 902, 1002, 1102 may be electrically separated by non-conductive boundary areas 106, 206, 906, 1006, 1106. In FIGS. 1 and 2, each of the stator sections 102, 202 and 104, 204 may be operated independently through the use of conductors 112, 212 and 114, 214, respectively. For example, when the stator sections 102, 202 and 104, 204 are used to generate sound (e.g., in a headphone), the conductors 112, 212 and 114, 214 may carry one or more audio source signals. As another example, when the stator sections 102, 202 and 104, 204 are used to sense sound (e.g., in a microphone), the conductors 112, 212 and 114, 214 may be electrically connected to an appropriate circuit that generates a microphone output signal. Exemplary embodiments of electrostatic transducers utilizing one or more circular segmented stator plates 100 are described in more detail below with respect to FIGS. 3, 5, and 6.

Similarly, each of the stator sections 902 in FIG. 9 may be operated independently through the use of conductors 912, and each of the stator sections 1002 in FIG. 10 may be operated independently through the use of conductors 1012. Exemplary embodiments of electrostatic transducers for generating sound are described in more detail below with respect to FIGS. 7 and 9, and exemplary embodiments of electrostatic transducers for sensing sound are described in more detail below with respect to FIGS. 8 and 10.

In embodiments, the boundary areas 106, 206, 906, 1006, and 1106 of the segmented stator plates 100, 200, 900, 1000, and 1100 may be non-conductive and may or may not be located at a node line of a mode of a diaphragm (not shown in the figures). The diaphragm can be used in conjunction with segmented stator plates in an electrostatic transducer, such as a loudspeaker, headphone, or earphone. When the segmentation of a stator plate occurs along a diaphragm modal node line of the second radial mode, the modal weighting of the second mode shape can be varied. The modal configuration that most closely matches a particular stator segmentation may couple the strongest to that particular stator segmentation, and can therefore be isolated electrically.

Figure 7:
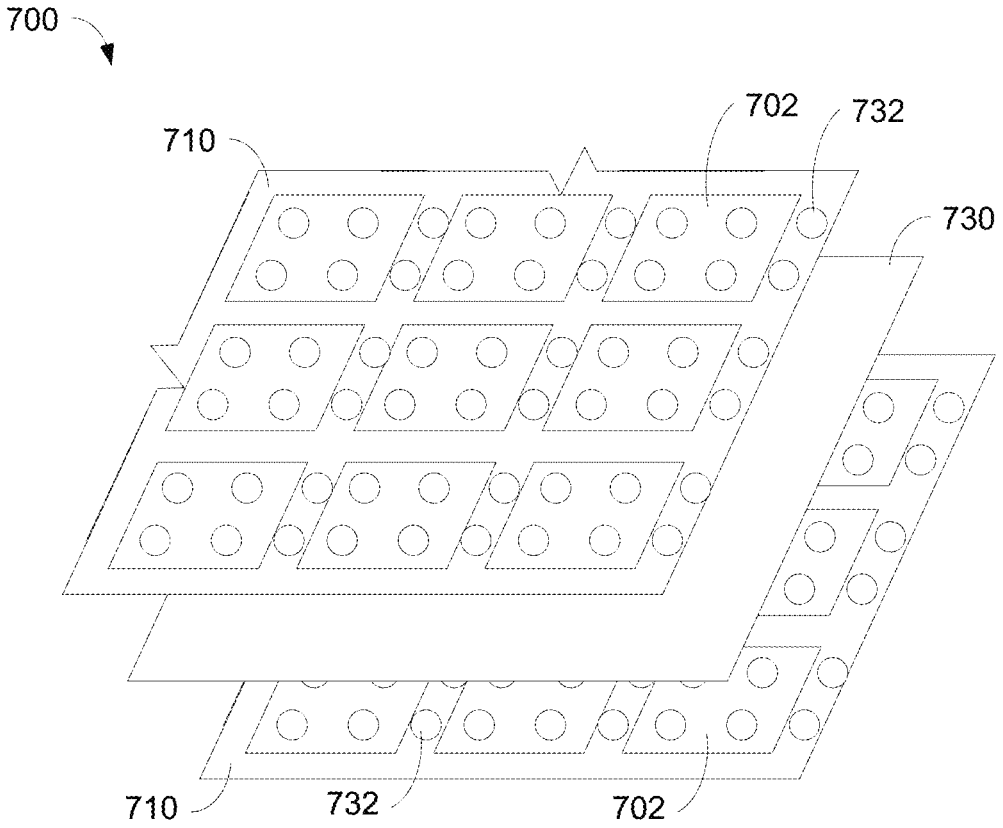
FIG. 7 is a partially exploded view of an exemplary depiction of a portion of an electrostatic transducer having segmented stator plates and that can generate sound, in accordance with some embodiments.
Figure 8:
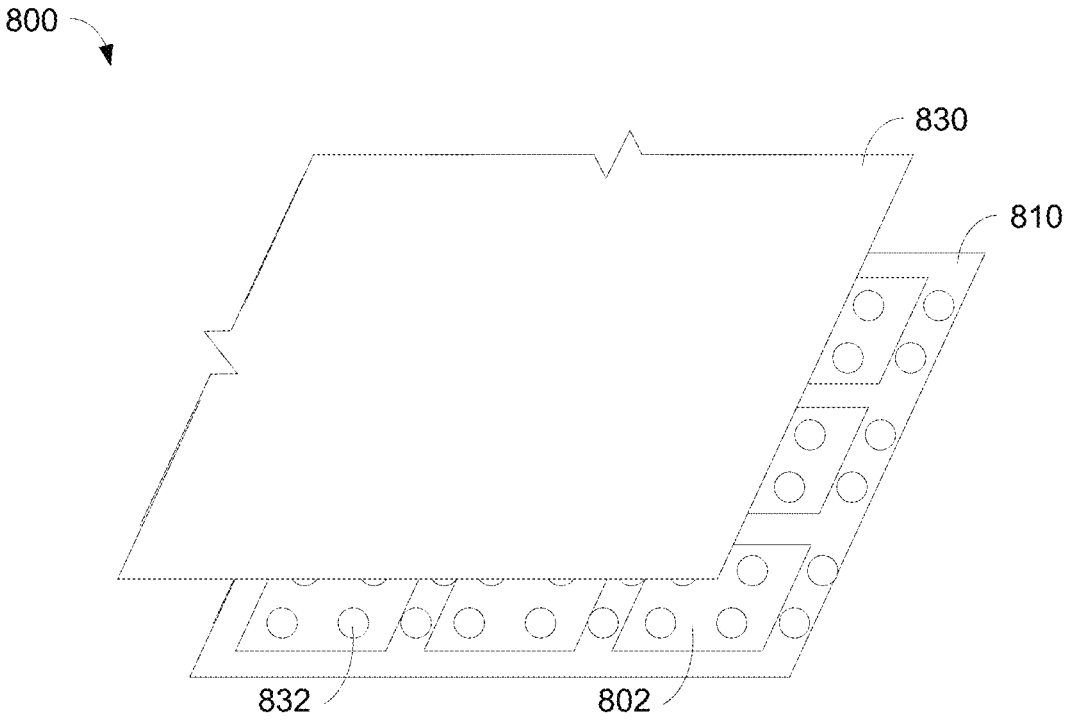
FIG. 8 is a partially exploded view of an exemplary depiction of a portion of an electrostatic transducer having a segmented stator plate and that can sense sound, in accordance with some embodiments.

The segmented stator plates 100, 200, 900, 1000, and 1100 may be porous and include one or more through holes (not shown in FIGS. 1, 2, 9, 10, and 11) that allow acoustic transmission of sound through the stator plates, e.g., sound generated by a diaphragm, and/or sound waves to be sensed from the environment by a diaphragm. FIG. 7 shows a portion of an electrostatic transducer 700 with segmented stator plates 710 and a diaphragm 730 for generating sound, and FIG. 8 shows a portion of an electrostatic transducer 800 with a segmented stator plate 810 and a diaphragm 830 for sensing sound. The segmented stator plates 710 and 810 are shown in FIGS. 7 and 8 with multiple stator sections 702 and 802, respectively, as well as multiple through holes 732 and 832, respectively. The through holes 732, 832 may be arranged in any suitable number and/or pattern to allow acoustic transmission of sound through the stator plates 702, 802.

In embodiments, the segmented stator plates 100, 200, 900, 1000, 1100 may be a printed circuit board (PCB) constructed of epoxy laminate, e.g., FR4, with etched copper layers to create selectively conductive surfaces. The conductors 112, 114, 212, 214, 912, 1012, traces, and/or contacts may be present on one layer of the PCB while other portions of the segmented stator plates 100, 200, 900, 1000, 1100 may be present on one or more layers of the PCB. The layers of the PCB may be attached and/or adhered to one another, as is known in the art. Electrical connections between layers of the PCB may be accomplished through appropriate vias.

Figure 3:
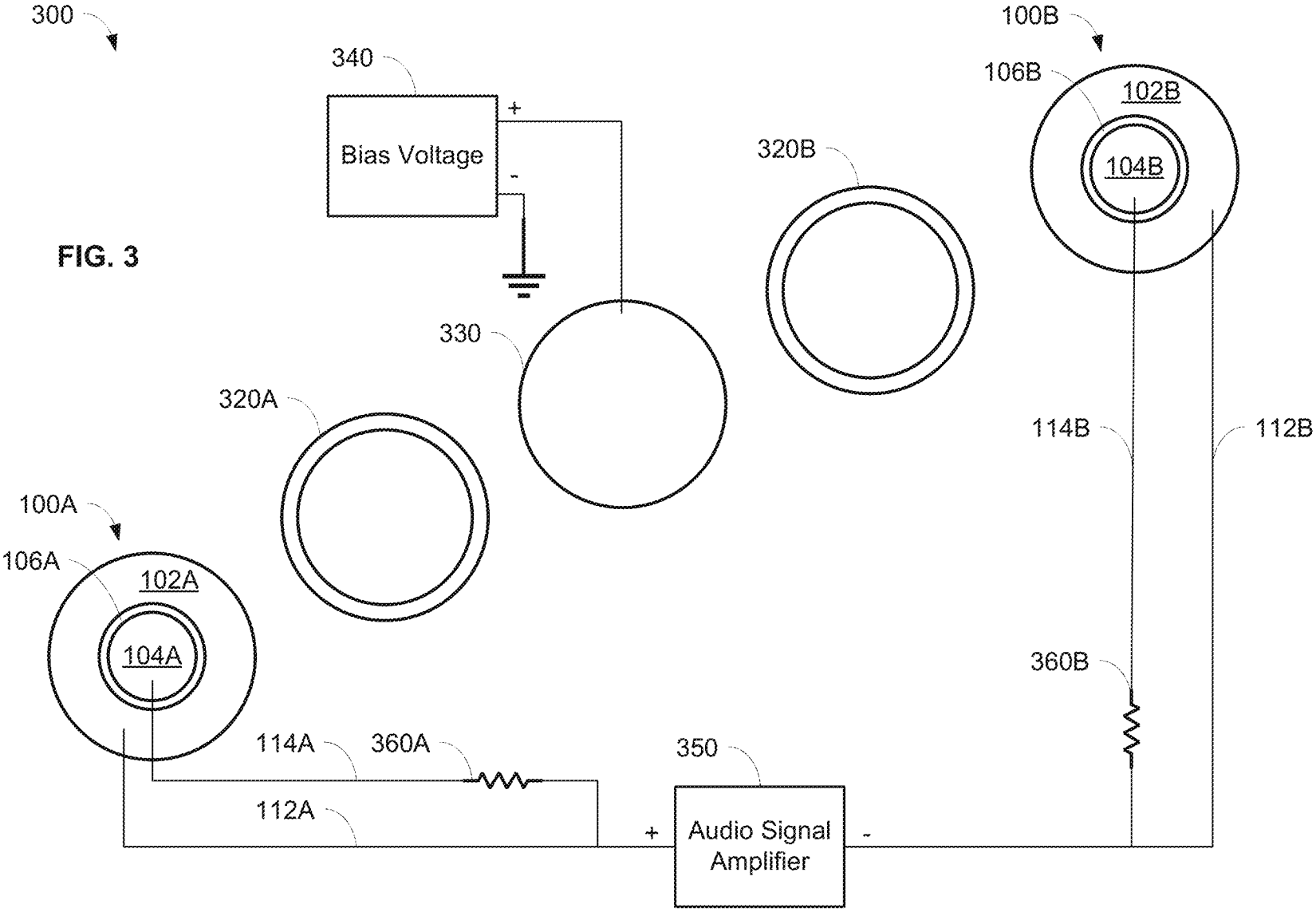
FIG. 3 is a schematic diagram and an exploded view of a portion of an electrostatic transducer having segmented stator plates and that can generate sound based on a single audio signal source, in accordance with some embodiments.
Figure 5:
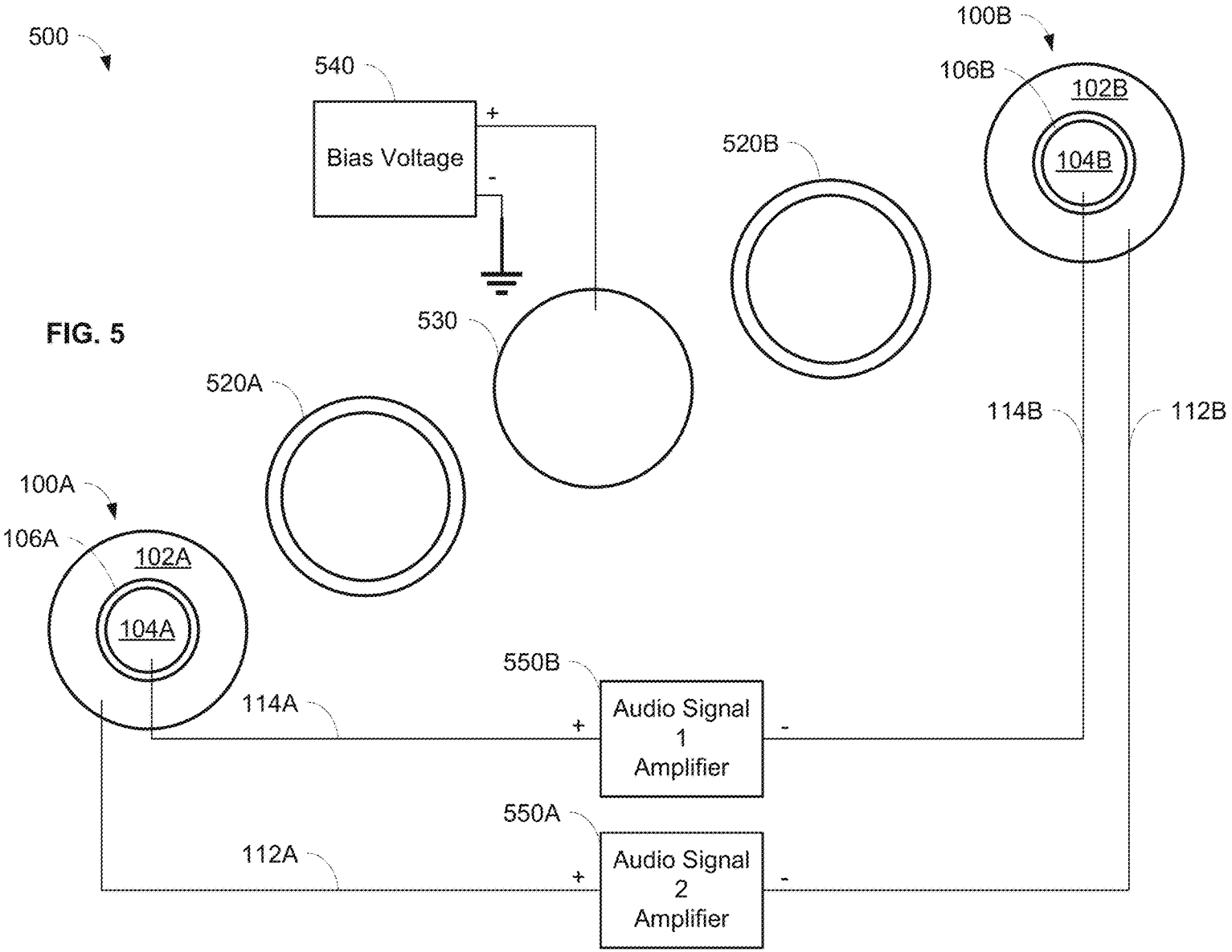
FIG. 5 is a schematic diagram and an exploded view of a portion of an electrostatic transducer having segmented stator plates and that can generate sound based on multiple audio signal sources, in accordance with some embodiments.

FIG. 3 is a schematic diagram and an exploded view of a portion of an electrostatic transducer 300 having circular segmented stator plates 100A, 100B. The electrostatic transducer 300 can generate sound based on a single audio signal source. FIG. 5 is a schematic diagram and an exploded view of a portion of an electrostatic transducer 500 having circular segmented stator plates 100A, 100B. The electrostatic transducer 500 can generate sound based on multiple audio signal sources. The electrostatic transducers 300 and 500 can be a loudspeaker, headphone, or earphone, for example. Although circular segmented stator plates 100A, 100B and circular diaphragms 330 and 530 are shown in FIGS. 3 and 5, it should be understood that other shapes of the segmented stator plates and diaphragm, as well as configurations of stator sections, are contemplated and possible for use in electrostatic transducers, such as those shown in FIGS. 7 and 9.

The electrostatic transducers 300 and 500 may generate sound when one or more equal magnitude opposite-phase AC audio signals are applied to a pair of segmented stator plates 100A, 100B that displace and deflect a diaphragm 330 and 530 positioned between the segmented stator plates 100A, 100B. In particular, one or more audio signals may be applied to the stator sections 102A, 102B and 104A, 104B of each of the segmented stator plates 100A, 100B, as described in more detail below. The diaphragms 330 and 530 in turn displace air to generate the sound according to the audio signals. Each of the segmented stator plates 100A, 100B may include holes (not shown) for allowing the acoustic transmission of sound generated by the diaphragms 330 and 530. For example, in an earphone, the generated sound may be output through the holes of the segmented stator plates 100A, 100B and through a nozzle to an ear canal of a listener.

The AC audio signals may include a positive polarity and a negative polarity that may be electrically connected to the sections of the segmented stator plates 100A, 100B. The AC audio signals may be created and/or derived from an external audio source, such as a media player, mobile phone, smartphone, stereo system, computer, tablet, compact disc player, or other device. The external audio source may be connected to an audio signal amplifier 350, 550A, and 550B via a stereo plug, USB connection, or other appropriate connection. The AC audio signal amplifier 350, 550A, and 550B may include one or more audio gain stages, high voltage differential gain stages, and/or high voltage output stages.

In embodiments, annular spacers 320A, 320B and 520A, 520B may be positioned between the diaphragm-facing sides of the segmented stator plates 100A and 100B and the diaphragms 330 and 530. The spacers 320A, 320B and 520A, 520B may be non-conductive and be used to provide spacing between the segmented stator plates 100A and 100B and the diaphragms 330 and 530, which allows the diaphragms 330 and 530 to deflect when generating sound. The spacers may also serve the purpose of tensioning the diaphragms 330 and 530.

In embodiments, the diaphragms 330 and 530 may be constructed of a polymer film, such as PET (polyethylene terephthalate) or PPS (polyphenylene sulfide), and have a thin conductive coating on one or both sides. The diaphragms 330 and 530 may be electrically connected to a DC bias voltage power supply 340 and 540, respectively. The DC bias voltage power supply 340 and 540 may be created by a voltage multiplier circuit from an appropriate power source, such as alkaline batteries, lithium batteries, a USB port, a DC power supply connected to an AC wall outlet, and/or other power sources. The voltage multiplier circuit may include one or more high voltage switching power supplies and/or other circuitry in order to sufficiently generate the DC bias voltage.

The electrostatic transducer 300 shown in FIG. 3 may be driven by a single AC audio signal from audio signal amplifier 350. In particular, the AC audio signal from the audio signal amplifier 350 may include a positive polarity and a negative polarity. The positive polarity audio signal from the audio signal amplifier 350 may be electrically connected to outer concentric stator section 102A of segmented stator plate 100A via conductor 112A. The negative polarity audio signal from the audio signal amplifier 350 may be electrically connected to outer concentric stator section 102B of segmented stator plate 100B via conductor 112B.

The audio signal may also be delayed through resistors 360A, 360B before reaching the central circular stator sections 104A, 104B. In particular, the positive polarity audio signal from the audio signal amplifier 350 may be electrically connected to resistor 360A. The resulting delayed positive polarity audio signal from the resistor 360A may be electrically connected to central circular stator section 104A of the segmented stator plate 100A via conductor 114A. Similarly, the negative polarity audio signal from the audio signal amplifier 350 may be electrically connected to resistor 360B. The resulting delayed negative polarity audio signal from the resistor 360B may be electrically connected to central circular stator section 104B of the segmented stator plate 100B via conductor 114B. In embodiments, the resistors 360A, 360B may each have a value of 30 MΩ, or may be another appropriate value.

Figure 4A:
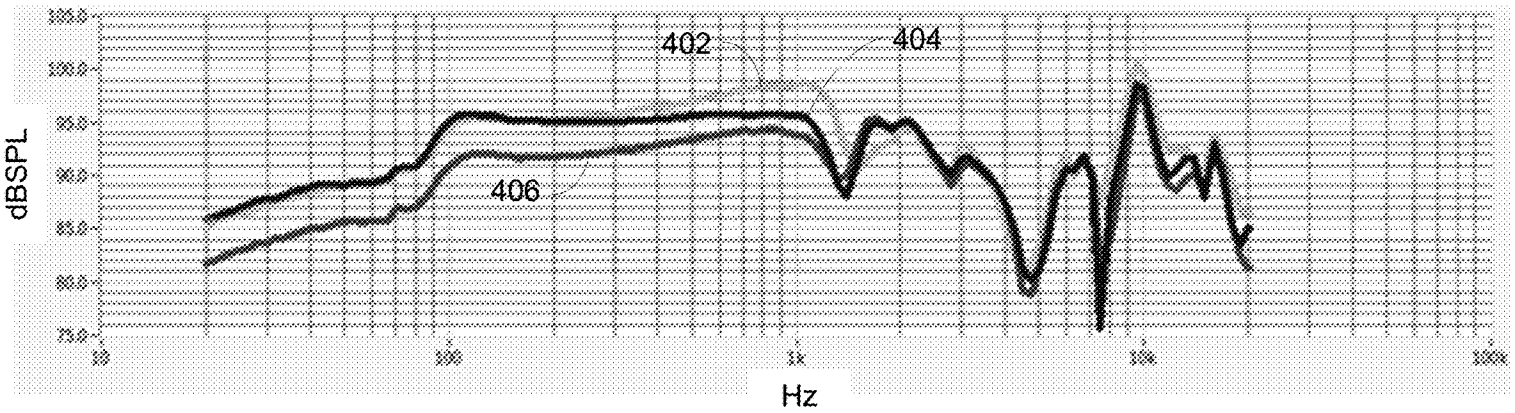
FIG. 4A is an exemplary graph showing the performance of the electrostatic transducer of FIG. 3, in accordance with some embodiments.

Delaying the audio signal to the central circular stator sections 104A, 104B may optimize the performance of the transducer 300. For example, the resulting frequency response in this scenario may include: (1) in the low frequency range, performance similar to when both the outer concentric stator section 102A, 102B and the central circular stator section 104A, 104B are driven together; and (2) in the mid frequency range, performance similar to when only the outer concentric stator section 102A, 102B is driven. This can be seen in the exemplary frequency response graph of FIG. 4A. Line 402 in FIG. 4A shows the performance across the frequency range when both the outer concentric stator section 102A, 102B and the central circular stator section 104A, 104B of the segmented stator plate 100A, 100B are driven together by an audio signal. This could occur, for example, when the positive polarity audio signal is electrically connected to both the outer concentric stator section 102A and the central circular stator section 104A of segmented stator plate 100A, and the negative polarity audio signal is electrically connected to both the outer concentric stator section 102B and the central circular stator section 104B of segmented stator plate 100B.

Line 406 of FIG. 4A shows the performance across the frequency range when only the outer concentric stator section 102A, 102B of the segmented stator plate 100A, 100B is driven by an audio signal. Line 404 of FIG. 4A shows the performance across the frequency range when the audio signal is delayed to the central circular stator section 104A, 104B, as in the configuration of the electrostatic transducer 300 shown in FIG. 3. As can be seen in FIG. 4A, the performance shown by line 404 blends both the performance shown by line 402 in the low frequency range and the performance shown by line 406 in the mid frequency range.

Figure 4B:
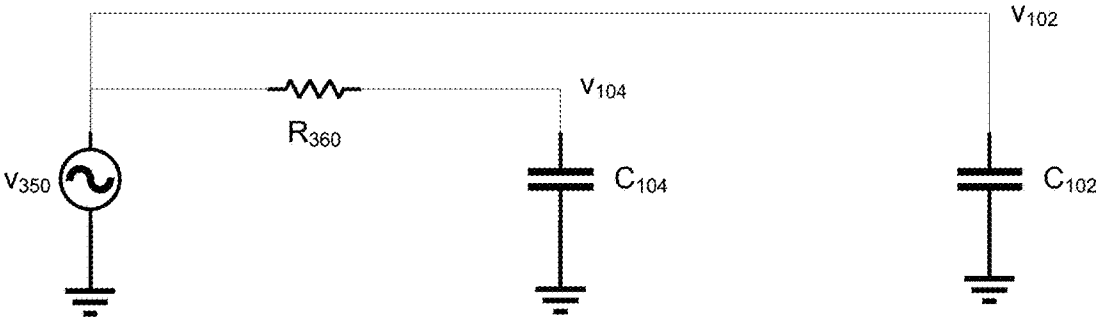
FIG. 4B is a schematic diagram of a circuit equivalent of a portion of the electrostatic transducer of FIG. 3.

The resistors 360A, 360B and the capacitance of the central circular stator sections 104A, 104B of the electrostatic transducer 300 shown in FIG. 3 may form a low pass filter to the central circular stator sections 104A, 104B, which effectively shuts off the contribution from the central circular stator sections 104A, 104B above the filter cut-off frequency. A schematic showing an equivalent circuit of this low pass filter is shown in FIG. 4B.

The electrostatic transducer 500 shown in FIG. 5 may be driven by multiple AC audio signals from audio signal amplifiers 550A and 550B. In particular, the positive polarity audio signal from a first audio signal amplifier 550A may be electrically connected to outer concentric stator section 102A of segmented stator plate 100A via conductor 112A, and the negative polarity audio signal from the first audio signal amplifier 550A may be electrically connected to outer concentric stator section 102B of segmented stator plate 100B via conductor 112B. Similarly, the positive polarity audio signal from a second audio signal amplifier 550B may be electrically connected to central circular stator section 104A of segmented stator plate 100A via conductor 114A, and the negative polarity audio signal from the second audio signal amplifier 550B may be electrically connected to central circular stator section 104B of segmented stator plate 100B via conductor 114B.

By electrically connecting different audio signals to the sections of the segmented stators 100A, 100B, the electrostatic transducer 500 may be able to generate spatialization and synthesize sound fields, in some embodiments. In other embodiments, audio signals for different frequency ranges may be electrically connected to different sections of the segmented stators 100A, 100B of the electrostatic transducer 500. For example, a crossover circuit may be utilized to generate the separate AC audio signals for different frequency ranges from an AC audio signal that includes the whole frequency range. In this way, the electrostatic transducer 500 may have the flexibility to be used in different scenarios and implementations while being in an integrated package.

In embodiments, the electrostatic transducers 300, 500 may be mounted within an open-back or a closed-back housing of a headphone or an earphone. The housings may be constructed of a suitable non-conductive material, such as plastic. As is known in the art, other features of the housings may include suitable acoustic ports and resistance screens to assist in tuning the frequency response by setting acoustical impedances.

As previously discussed, FIG. 7 shows an exemplary depiction of an electrostatic transducer 700 with segmented stator plates 710 with stator sections 702 and a diaphragm 730 for generating sound. FIG. 9 is a schematic diagram and a top view of a portion of a segmented stator plate 900 with stator sections 902 that is electrically connected to a processor 960 and amplifiers 950 to generate sound. The stator plate 900 of FIG. 9 may be one of the stator plates 710 shown in FIG. 7, although the stator plate 900 of FIG. 9 does not show through holes for simplicity and clarity. It should be understood that only a portion of the stator plates 700 and 900 is shown in FIGS. 7 and 9, and that the stator plates 700 and 900 may include further stator sections 702, 902 and through holes 732.

Similar to the electrostatic transducer 300 in FIG. 3 and the electrostatic transducer in FIG. 5, the electrostatic transducer 700 of FIG. 7 may generate sound when audio signals are applied to the segmented stator plates 710 to displace and deflect the diaphragm 730, since the diaphragm 730 is positioned between the segmented stator plates 710. In particular, the diaphragm 730 may be displaced and deflected when the stator sections 702 of the segmented stator plates 710 are driven by the audio signals. As shown in FIG. 9, the audio signals may be created by the processor 960 and amplified by the amplifiers 950 to drive each of the stator sections 902 via conductors 912. The processor 960 may receive an external audio signal from an external audio source, as well as power and control signals, in order to suitably create the audio signals for each of the stator sections 902. In some embodiments, the processor 960 may drive each of the stator sections 902 with the same audio signal, and in other embodiments, the processor 960 may drive different stator sections 902 with different audio signals (e.g., if the control signal denotes to steer the generated sound in a certain direction).

In further embodiments, an electrostatic transducer may include both: (1) a set of stator sections that are driven to generate sound and are electrically connected to amplifiers, and (2) a set of stator sections that can sense sound and are electrically connected to buffers. With respect to the stator segments used for sensing sound, the output from these stator segments may be a superposition of the displacement created by the audio signal and the sensed pressure. A processor may manage the subtraction of the audio signal to leave only the sensed pressure. A signal with the sensed pressure (i.e., corresponding to the sensed sound) can be utilized by the processor, other systems, and/or other devices for functions such as active noise cancellation, calibration, etc.

Figure 6A:
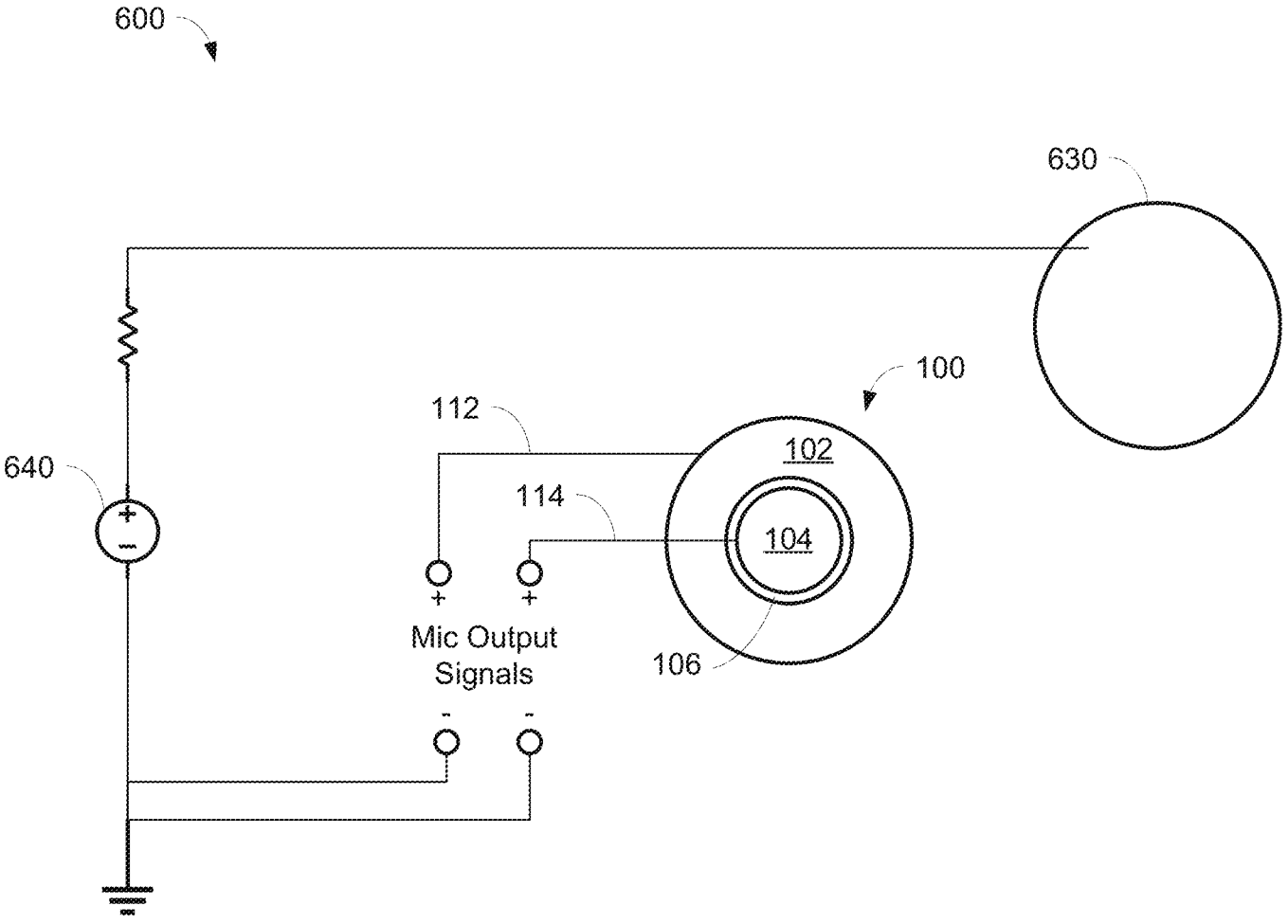
FIG. 6A is a schematic diagram and an exploded view of a portion of an electrostatic transducer having a segmented stator plate and that can sense sound, in accordance with some embodiments.
Figure 6B:
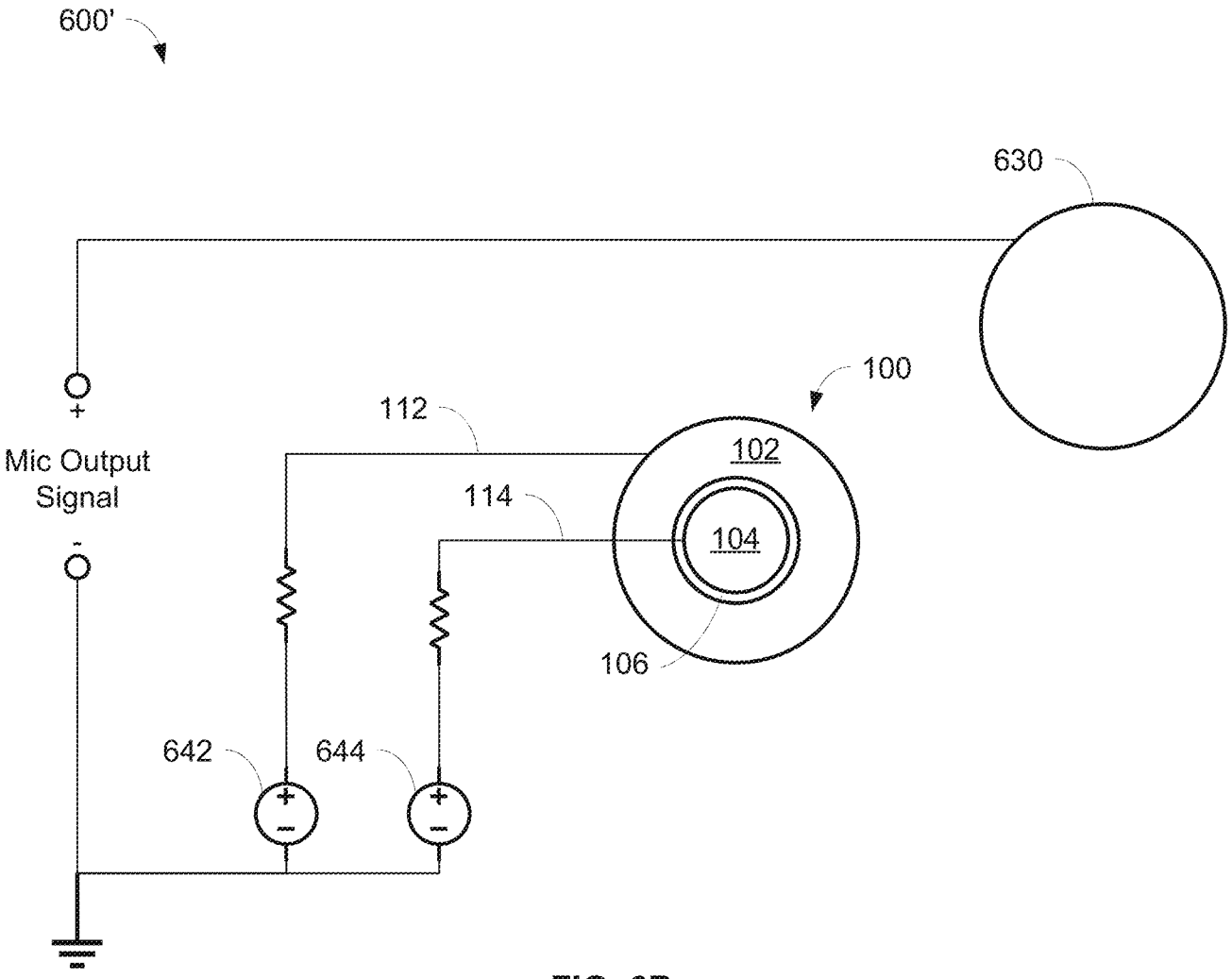
FIG. 6B is a schematic diagram and an exploded view of a portion of an electrostatic transducer having a segmented stator plate and that can sense sound, in accordance with some embodiments.

FIGS. 6A and 6B are schematic diagrams and exploded views of a portion of an electrostatic transducer 600, 600' having a circular segmented stator plate 100. The electrostatic transducer 600 can sense sound waves and generate an audio output signal based on the sensed sound. The electrostatic transducer 600, 600' can be a microphone, for example. Although a circular segmented stator plate 100 and a circular diaphragm 630 is shown in FIGS. 6A and 5B, it should be understood that other shapes of the segmented stator plates and diaphragm, as well as configurations of stator sections, are contemplated and possible for use in electrostatic transducers, such as those shown in FIGS. 8 and 10.

The electrostatic transducer 600, 600' may sense sound waves when the sound waves strike the diaphragm 630 to move and vibrate it. As the distance between the diaphragm 630 and the segmented stator plate 100 changes, the capacitance between the diaphragm 630 and the segmented stator plate 100 also changes, which is then converted into an audio output signal. In particular, the segmented stator plate 100 may act as a backplate for the diaphragm 630, and may include holes that allow sound waves to strike the diaphragm on both sides. In embodiments, the rear of the segmented stator plate 100 may be open to the environment.

In some embodiments, the diaphragm 630 and the segmented stator plate 100 may be mounted within a housing so that they are separated from one another to allow deflection and movement of the diaphragm 630. Such a housing may also tension the diaphragm 630. In other embodiments, a spacer may be positioned between the diaphragm 630 and the segmented stator plate 100 to separate them, and the spacer may also be used to tension the diaphragm 630.

A suitable power source 640 may be electrically connected such that there is a voltage across the diaphragm 630 and the stator sections 102 and 104 of the segmented stator plate 100. The capacitance between each of the stator sections 102 and 104 and the diaphragm 630 may change as sound waves strike the diaphragm 630.

The embodiment shown in FIG. 6A of the electrostatic transducer 600 includes a single bias voltage 640 applied to the diaphragm 630. In this embodiment, the output audio signal generated by the electrostatic transducer 600 may be split between the two stator sections 102 and 104. The contribution from each stator section 102, 104 to the output audio signal may be proportional to the bias voltage 640 multiplied by the average displacement of the stator section 102, 104. As such, if the average displacement of each stator section 102, 104 is the same, then the contribution from each stator section 102, 104 to the output audio signal is the same. If the average displacement of each stator section 102, 104 is different (or opposite polarity), then the contribution from each stator section 102, 104 to the output audio signal when summed is proportional to that difference.

The embodiment shown in FIG. 6B of the electrostatic transducer 600' includes bias voltages 642, 644 applied to the stator sections 102, 104, respectively. In this embodiment, the output audio signal generated by the electrostatic transducer 600' may be taken from the diaphragm 630. The contribution from each stator section 102, 104 to the output audio signal may be proportional to the respective voltage 642, 644 multiplied by the average displacement of the stator section 102, 104.

A multi-pole single capsule microphone may be created by utilizing a segmented stator plate 100 in the electrostatic transducer 600, 600'. Such a microphone can have highly directional pickup patterns in the near field while being less sensitive to the far field. For example, if a source of audio is near the center of the electrostatic transducer 600, 600', the center of the diaphragm 630 that is coupled to the central stator section 104 may be excited or vibrated more than the periphery of the diaphragm 630 that is coupled to the concentric stator section 102. This configuration may represent a far field noise cancelling microphone transducer. In particular, when both the front and back of such a transducer are exposed to an incident pressure wave, the transducer can cancel both on-axis and 90 degree plane waves.

In embodiments, the diaphragm-facing side of the segmented stator plate 100 may be coated with an electret layer, such as FEP (fluorinated ethylene propylene) and/or PTFE (polytetrafluoroethylene). The electret layer may have a surface charge distribution that couples to mode shapes of the diaphragm 630, and is in lieu of having the power source 640 supply a voltage across the diaphragm 630 and the stator sections 102 and 104 of the segmented stator plate 100.

As previously discussed, FIG. 8 shows an exemplary depiction of an electrostatic transducer 800 with segmented stator plates 810 and a diaphragm 830 for sensing sound. FIG. 10 is a schematic diagram and a top view of a portion of a segmented stator plate 1000 with stator sections 1002 that is electrically connected through buffers 1050 to a processor 1060 to sense sound. The stator plate 1000 of FIG. 10 may utilized in lieu of the stator plate 810 shown in FIG. 8, although the stator plate 1000 of FIG. 10 does not show through holes for simplicity and clarity. It should be understood that only a portion of the stator plates 800 and 1000 is shown in FIGS. 8 and 10, and that the stator plates 800 and 1000 may include further stator sections 802, 1002 and through holes 832.

Similar to the electrostatic transducer 600 in FIG. 6A and 600' in FIG. 6B, the electrostatic transducer 800 of FIG. 8 may sense sound when sound waves strike the diaphragm 830 to move and vibrate it. In particular, the diaphragm 830 may be exposed to the environment such that the sound waves can strike it, and as the distance between the diaphragm 830 and the stator plate 810 below it changes, the capacitance between the diaphragm 830 and the stator plate 810 also changes, which is then converted into an audio signal. As shown in FIG. 10, the audio signal from each of the stator sections 1002 may be received at a processor 1060 after being conveyed by conductors 1012 and buffered by buffers 1050. The processor 1060 may process the audio signals from the stator sections 1002 to suitably generate one or more audio output signals. For example, in some embodiments, the processor 1060 may generate a single audio output signal that takes into account some or all of the audio signals from the stator sections 1002. In other embodiments, the processor 1060 may generate multiple audio output signals that correspond to subsets of the audio signals from the stator sections 1002, where each audio output signal may correspond to a particular lobe or pick-up pattern, for example.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. An electrostatic transducer, comprising:

a diaphragm in electrical contact with a bias voltage;

a pair of stator plates, each comprising:

a first section in electrical contact with a first audio signal;

a second section electrically separate from the first section and in electrical contact with a second audio signal; and a boundary area between the first section and the second section, the boundary area configured to be located at a node line of a mode of the diaphragm;

wherein the diaphragm generates sound when the bias voltage, the first audio signal, and the second audio signal are supplied.

2. The transducer of claim 1, wherein each of the pair of stator plates further comprises a plurality of holes, and wherein the sound is output through the plurality of holes of each of the pair of stator plates.

3. The transducer of claim 1, further comprising a pair of non-conductive spacers each in contact with respective sides of the diaphragm and one of the pair of stator plates.

4. The transducer of claim 1, wherein one or more of the first section, the second section, and the boundary area are concentric.

5. The transducer of claim 4, wherein the second section is concentrically disposed within the boundary area and the boundary area is concentrically disposed within the first section.

6. The transducer of claim 1, wherein the second section is disposed within the boundary area and the boundary area is disposed within the first section.

7. The transducer of claim 1, wherein the second audio signal is based on the first audio signal.

8. The transducer of claim 1, further comprising a resistor in electrical communication with the first audio signal, the resistor configured to delay the first audio signal to generate the second audio signal.

9. An electrostatic transducer, comprising:

a diaphragm in electrical contact with a voltage;

a stator plate, comprising:

a first section in electrical contract with the voltage;

a second section electrically separate from the first section and in electrical contact with the voltage; and a boundary area between the first section and the second section, the boundary area configured to be located at a node line of a mode of the diaphragm;

wherein an audio signal is generated by the diaphragm and the stator plate based on sound waves detected by the diaphragm when the voltage is supplied.

10. The transducer of claim 9, wherein the stator plate further comprises a plurality of holes, and wherein the sound is detected through the plurality of holes of the stator plate.

11. The transducer of claim 9, wherein one or more of the first section, the second section, and the boundary area are concentric.

12. The transducer of claim 11, wherein the second section is concentrically disposed within the boundary area and the boundary area is concentrically disposed within the first section.

13. The transducer of claim 9, wherein the second section is disposed within the boundary area and the boundary area is disposed within the first section.

14. A stator plate for an electrostatic transducer, comprising:

a plurality of sections, wherein each of the plurality of sections is electrically separate from each other of the plurality of sections; and a plurality of non-conductive boundary areas, wherein each of the plurality of sections is separated from a neighboring section by one of the plurality of boundary areas, and wherein at least one of the plurality of boundary areas is configured to located at a node line of a mode of a diaphragm of the electrostatic transducer.

15. The stator plate of claim 14, wherein the plurality of sections are arranged in a matrix formation.

16. The stator plate of claim 14, wherein the plurality of sections are linearly subdivided.

17. The stator plate of claim 14, wherein the stator plate is circular and wherein the plurality of sections are annularly subdivided.

18. The stator plate of claim 14, wherein each of the plurality of sections is electrically driven by an audio signal supplied by an amplifier.

* * * * *